United States Patent [19]

Bartimes et al.

[11] Patent Number: 4,637,600

[45] Date of Patent: Jan. 20, 1987

[54] LABEL SEPARATOR

[75] Inventors: George F. Bartimes, Chicago; Leonard A. Blomquist, Joliet, both of Ill.

[73] Assignee: Continental Plastic Containers, Inc., Stamford, Conn.

[21] Appl. No.: 346,817

[22] Filed: Feb. 8, 1982

[51] Int. Cl.[4] ..... B65H 3/32; B65H 3/40

[52] U.S. Cl. ..... 271/93; 271/101; 271/106; 271/134; 156/351; 156/362; 156/497; 156/572; 156/DIG. 29; 156/DIG. 31

[58] Field of Search ..... 156/564, 570, 571, 497, 156/572, DIG. 29, DIG. 31, 573, 215, 351, 362; 271/93, 99, 100, 101, 102, 106, 133, 134

[56] References Cited

U.S. PATENT DOCUMENTS

| | | | |
|---|---|---|---|
| 937,807 | 10/1909 | Hodge | 271/101 |
| 989,103 | 4/1911 | Amidon | 271/101 |
| 3,725,179 | 4/1973 | Kiss et al. | 156/572 |

FOREIGN PATENT DOCUMENTS

| | | | |
|---|---|---|---|
| 1214859 | 4/1966 | Fed. Rep. of Germany | 156/572 |

*Primary Examiner*—Michael Wityshyn
*Attorney, Agent, or Firm*—Charles E. Brown

[57] ABSTRACT

This relates to a label separator which is operative to separate a foremost label from a stack of labels in advance of such label being picked by a picker so as to assure that only one label is picked at a time and that the other labels in a stack of labels will not be disturbed. One end or edge portion of a foremost label is displaced relative to the remainder of the stack and after a gap has been formed between the displaced label and the next adjacent label in the stack, a blade enters in between these two labels so as to separate completely the foremost label from the remaining labels in the stack. The apparatus which effects the initial displacement has associated therewith a label support whereby the displaced label remains supported in its original alignment for reception by the picker.

6 Claims, 17 Drawing Figures

LABEL SEPARATOR

This invention relates in general to new and useful improvements in labelling equipment, and more specifically to labelling equipment wherein labels are provided in a stack and a single label is picked from the stack during each labelling operation.

Generally horizontal magazines are used in labelling although an angular elevation on the order of 45° is believed to be optimal. Applicants are familiar with labelling apparatus on production equipment which have utilized both horizontal and vertical magazines as dictated by other considerations of the labelling equipment. It has been found that labellers employing vertical magazines or stacks are preferred.

Two disadvantages have been encountered utilizing vertical magazine systems, particularly with the upper magazine. It is to be understood that when reference is made to vertical magazines, it is generally with reference to magazines which are inclined from 10° to 40° from the vertical. The disadvantages include the fact that too few labels in the magazine will permit bottom labels to bow out, and frequently this results in multiple labels being picked. Also, too many labels in the stack will weigh heavily upon the label support fingers, restricting removal of the lowest label by the picking head.

In accordance with this invention, it is proposed to provide a combined separator and support blade which will move in between the lowermost label and the remainder of the stack and serve the dual function of aiding in the support of the other labels of the stack and in separating the lowermost label from the remainder of the stack.

In order that the blade may enter in between the lowermost label and the remainder of the stack, it is necessary that provision be made for the blade entry by drawing down an end or edge of the lowermost label and retaining it in a separated relation to the next upper label. When the lowermost label is so positioned, the separator blade may enter into the two partially spaced labels as is required.

In accordance with this invention, it is proposed to cause initial displacement of an edge portion of a lowermost label from the remainder of the stack using a combined displacement head and support wherein a suction head will draw down the edge portion of the lowermost label in sequence with the advance of the separator blade. Most particularly, such a head is mounted for pivotal movement and is spring loaded upwardly, but is provided with cam followers which engage reciprocating cam elements which move with the blade separator.

Automatic means are provided for the actuation of the label separating mechanism in conjunction with the operation of label transfer mechanism including a picking head. Further, the suction head is automatically coupled to and released from a vacuum source in accordance with the position of the blade.

In accordance with this invention, the separation of the label occurs while a previously lowermost label is being transferred. Thus, as soon as a label is picked from the stack, the separator blade moves from adjacent the stack to an out-of-the-way position, the edge portion of the next lower label is drawn down, and the blade reenters into the stack.

With the above and other objects in view that will hereinafter appear, the nature of the invention will be more clearly understood by reference to the following detailed description, the appended claims, and the several views illustrated in the accompanying drawings:

IN THE DRAWINGS

Figure 1:
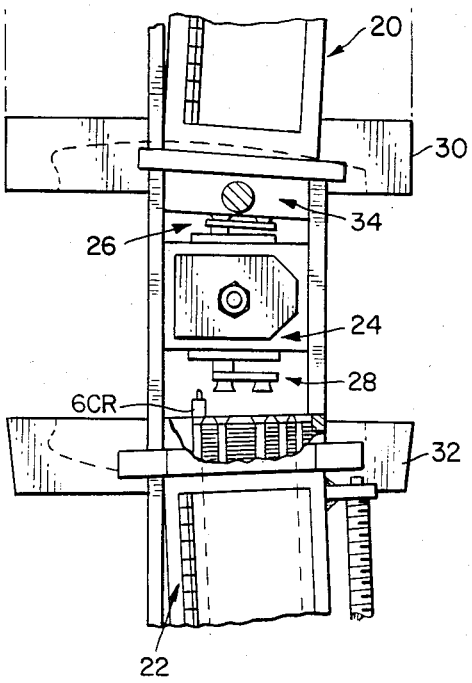
FIG. 1 is a fragmentary elevational view showing a portion of a rotary blow molding machine, the position of two label magazines and a picker for transferring labels from the magazines to the blow mold, the upper magazine having associated therewith the label separator of this invention.
Figure 2:
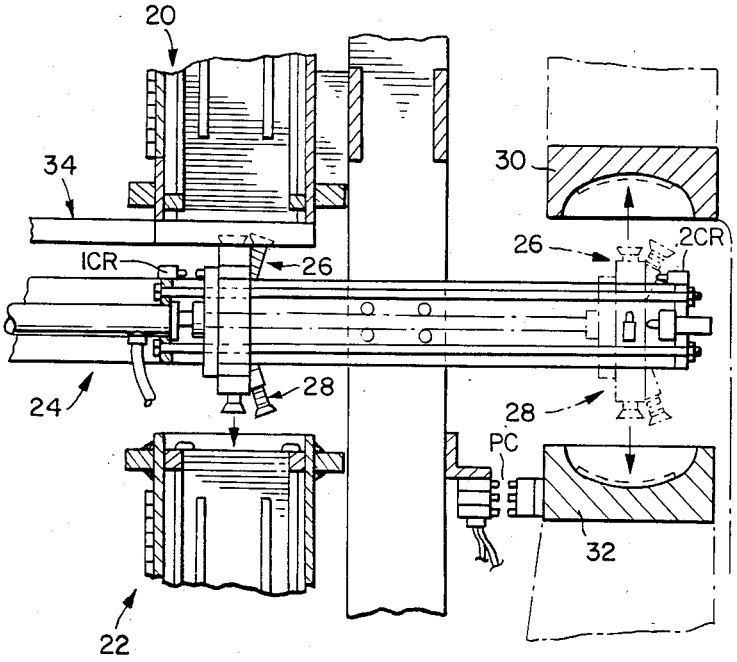
FIG. 2 is a longitudinal vertical sectional view taken through FIG. 1, and shows further the relationship of the magazines with respect to the label transferring mechanism and associated blow molds.

Referring now to the drawings in detail, reference is first made to FIGS. 1 and 2 where there is illustrated portions of a typical application of this invention. In FIGS. 1 and 2, there is illustrated an upper magazine 20 and a lower magazine 22 which are positioned to supply labels to a transfer unit 24 having opposed picker heads 26 and 28 which cooperate with the magazines 20 and 22, respectively, for withdrawing foremost labels therefrom and transferring the same into mold halves 30 and 32, respectively, of a conventional rotary blow molding machine.

As is generally shown in FIGS. 1 and 2, there is associated with the magazine 20 a label separator, generally identified by the numeral 34, which is the subject of this inventionl. Although the label separator 34 has been illustrated in association with only the upper magazine 20, it is to be understood that a like or similar label separator may also be associated with the magazine 22 should this be desirable. It is also to be noted that while the magazines 20 and 22 are generally vertically disposed, the label separator 34 could also be utilized in conjunction with horizontally disposed magazines.

Referring now to FIGS. 3–6, it will be seen that there is illustrated the specific details of the label separator 34 in association with the magazine 20. First of all, it is to be understood that the magazine 20 includes a housing 36 and that fixedly mounted within that housing are a plurality of vertically disposed guide rails 38 which are interconnected by vertically spaced frame members 40 of which only one is illustrated. Each vertical guide 38 is provided at the lower end thereof with an eccentrically mounted label stack retainer 42 which is formed of a flexible plastic material. It is also to be understood that the retainers 42 project into the path of the labels only to the extent that they retain the stack of labels within the magazine. It is to be understood that the lowermost label may be slightly deformed and thus picked from the bottom of the stack of labels, the labels being identified as labels L.

It has been found that there is a tendency for more than one label to be dispensed, and when this occurs, then the blow molded article to which the label is applied becomes a defect. Accordingly, it is essential that a single label be picked from the magazine upon each operation of the transfer apparatus 24.

It is also essential that the next following label does not move partially out of the magazine 20 so as to be displaced in that this label, when picked, will not be properly positioned in its respective blow mold half and therefore will also result in a blow molded article which is imperfect.

As above described, in accordance with this invention it is proposed to separate the foremost label in the magazine 20 from the remaining labels in the stack of labels so that when it is picked by the associated picker head 26, only a single label will be transferred without the other labels of the stack being disturbed.

To the foregoing end, the label separator 34 is divided into two components, a dispensing means 44 and a separator means 46. The dispensing means 44 also functions as label support means.

The dispensing means 44 includes a generally U-shaped frame 48 which includes a pair of arms 50 connected together by a cross bar 52. The arms 50 are generally horizontally disposed and the ends of the arms 50 remote from the cross bar 52 and the separator means 46 are pivotally mounted on transversely aligned pivot pins 54 carried by brackets 56 which are suitably mounted on the frame 36. In this manner, the frame 48 may pivot toward and away from the bottom of the stack of labels within the magazine 20. In order to control the position of the frame 48, there is provided a shaft 58 which extends between the arms 50 adjacent the cross bar 52 and parallel thereto. The ends of the shaft 58 extend beyond the arms 50 and have releasably connected thereto tension springs 60 which have their opposite ends anchored on pins 62 carried by the frame 36.

The shaft 58 carries an elongated sleeve 64 which, in turn, carries a plurality of rollers 66 which are positioned to underlie the stack of labels and to engage and support the lowermost label in the stack. The rollers 66 function to prevent downward bowing of the central portions of the label which would permit the labels to disengage from the retainers 42.

There are also outermost rollers 68 which function as cam followers in a manner to be described hereinafter for urcing the frame 48 to pivot away from the lowermost label L in opposition to the tension of the springs 60.

The cross bar 52 carries a series of suction cups or suction heads 70 on the face thereof opposing the foremost label L in the magazine 20. The suction cups 70 are so positioned whereby, when the rollers 66 contact the lowermost label, the suction cups are also in operative contact with the label. A vacuum is supplied to the suction cups 70 in a conventional manner through a manifold 72 which is mounted on the cross bar 52 and which has an internal passage 74 in communication with each of the suction heads or suction cups 70. As is schematically illustrated, the manifold 72 has connected thereto a vacuum line 76 which leads to a vacuum source 78 through an intermediate solenoid actuated, normally closed valve 80.

It is to be understood that when the frame 48 is moved downwardly, the suction cups 70 will tilt to peel one end or edge of the lowermost label L downwardly with the label being continued to be supported by the rollers 66 adjacent that one label end or edge.

The separator means 46 includes a pair of elongated guide members 82 which are shaped to define oppositely opening guideways 83 in which there is positioned side edges of a separator blade 84 which is mounted for reciprocation transversely of the cross bar 52. The ends of the guide members 82 positioned adjacent the magazine 20 are supported by means of brackets 86 which are fixedly secured to the magazine housing 36.

Figure 4:
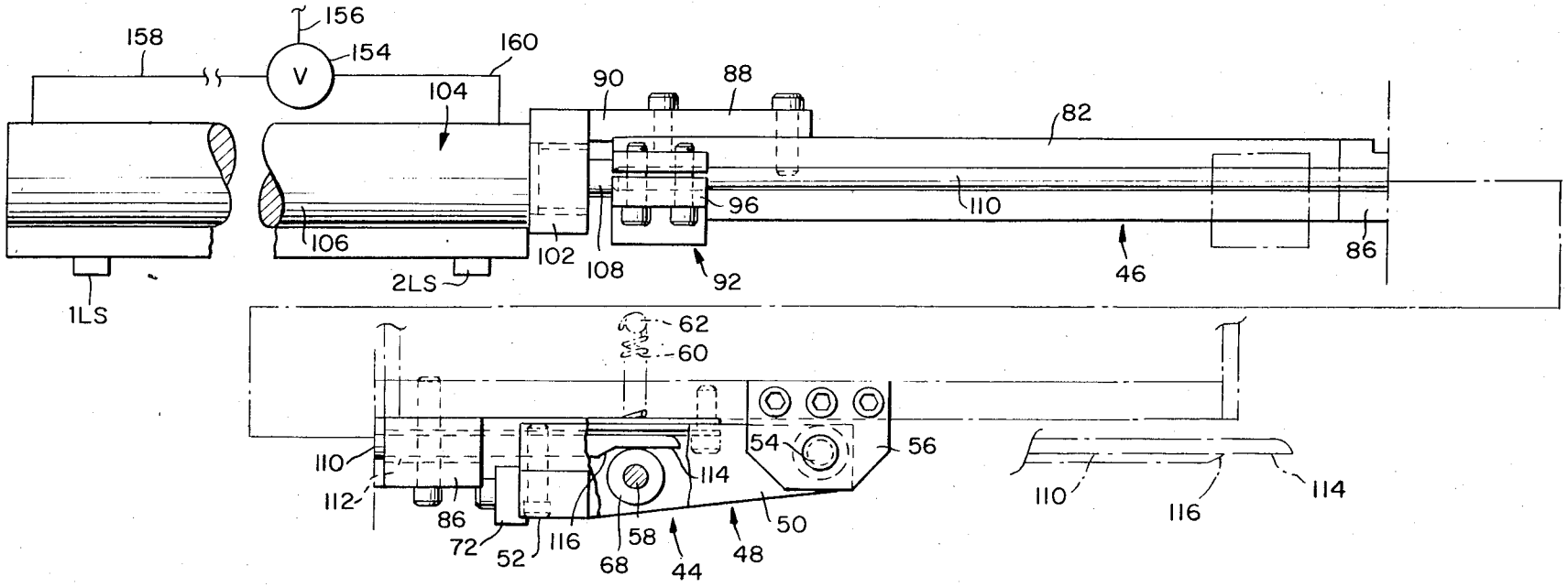
FIG. 4 is a side elevational view of the label separator with parts broken away to show the details of the actuating cams and followers.
Figure 5:
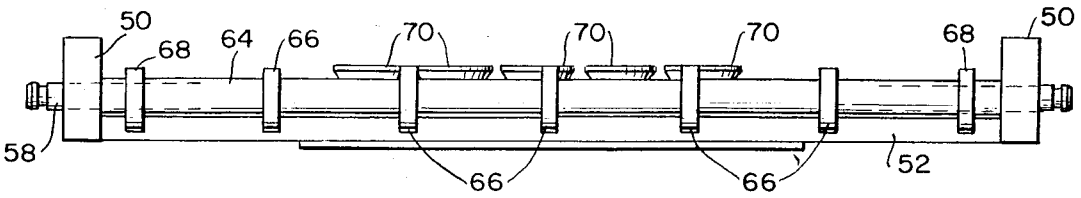
FIG. 5 is a right elevational view showing further details of the label separator.

The remote ends of the guide members 82 are also interconnected by means of a cross bar 88 which is of an angle configuration, as is best shown in FIG. 4, and includes a vertical flange 90.

Figure 6:
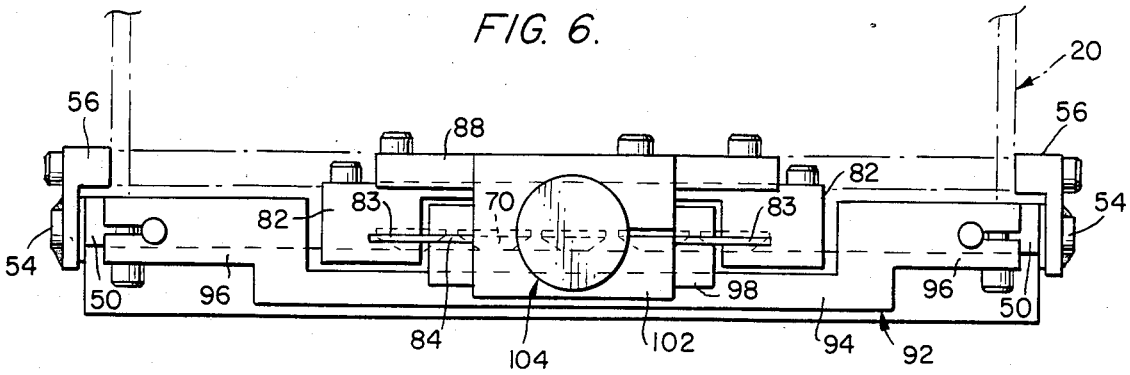
FIG. 6 is a left elevational view of the label separator.

The end of the blade 84 remote from the magazine 20 is provided with a cross bar 92 which includes, as is best shown in FIG. 6, a recessed central portion 94 and outer portions 96. The recessed central portion 94 has connected thereto by means of suitable mounting blocks 98 a narrowed terminal portion 100 of the blade 84.

The vertical flange 90 of the cross bar 88 carries a mounting bracket 102 for a double acting extensible fluid motor 104 of the type which includes a cylinder 106, a piston (not shown), and a piston rod 108. The forward end of the piston rod 108 has clamped thereto the mounting block 98, which is of a split construction, so as to connect the piston rod 108 to the blade 84 for movement therewith.

The outer ends 96 of the cross bar 92 have clamped therein the ends of actuator rods 110 which extend toward the magazine 20. The ends of the actuator rods 110 disposed adjacent the magazine 20 are guided within sleeve bearings 112 carried by the brackets 86. The ends of the actuator rods 110 remote from the cross bar 92 are flattened as at 114 (FIG. 4) and include intermediate cams 116. The flattened portions 114 underlie the respective rollers 68 with the cams 116 being disposed immediately adjacent such rollers. It thus will be seen that when the fluid motor 104 is actuated to advance the blade 84, the actuator rods 110 will serve to cam the rollers 68 and thus the frame 48 away from the stack of labels so as to render the displacing means 44 operative prior to the movement of the blade 84 into the position of the stack of labels.

Figure 8:
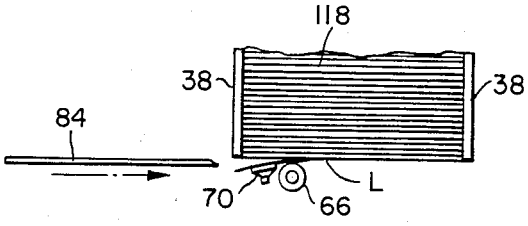
FIG. 8 is a schematic elevational view showing the initial step of displacing an edge portion of a label in the separation of a lowermost label from the remainder of the stack.
Figure 9:
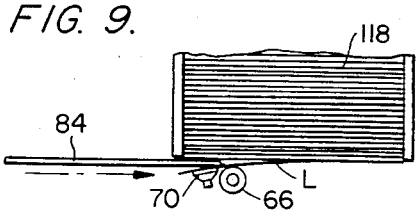
FIG. 9 is a schematic elevational view similar to FIG. 8 showing the blade having initially advanced in between the lowermost label and the remainder of the stack.
Figure 10:
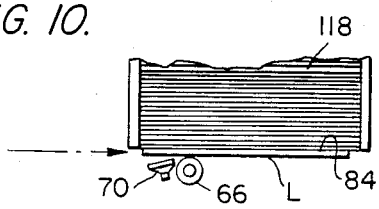
FIG. 10 is another schematic elevational view showing the blade in its fully inserted position completely separating the lowermost label from the remainder of the stack ready for removal.

Reference is now made to FIGS. 8–13 wherein there is illustrated in a schematic manner the operation of the label separator. With reference to FIG. 8, it will be seen that when the frame 48 is pivoted away from the label stack 118, the suction head 70 peels off an end or edge portion of the lowermost label L while that label is in part supported by the rollers 66 and is otherwise supported by many of the retainers 42. The stack of labels is now ready to receive the blade 84 between the lowermost label and the next upper label. Thus, as the piston rod 108 continues to advance, moving the blade, the blade will enter into the gap between the lowermost label and the remainder of the stack, as is shown in FIG. 9. In FIG. 10, the blade is illustrated in its fully inserted position separating the lowermost label L from the remainder of the stack 118. This label is now primarily supported by the suction cups 70 and the rollers 66, although the far end of the label may be supported by several of the retainers 42. The lowermost label L is now ready to be picked by the picker 26.

Figure 11:
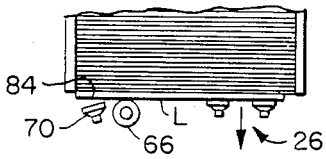
FIG. 11 is another schematic elevational view showing the picker engaging the lowermost label preparatory to removing it from the stack.

In FIG. 11 the lowermost label L is illustrated as having been picked by the picker 26 and is now moving away from the stack 118. At the same time, reverse movement of the blade 84 has been initiated.

Figure 12:
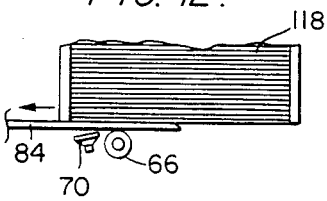
FIG. 12 is yet another schematic elevational view showing the previous lowermost label removed by the picker and the blade moving out from beneath the stack.
Figure 13:
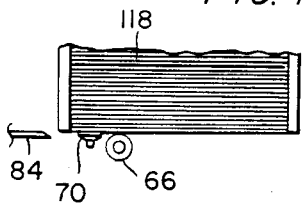
FIG. 13 is a further schematic elevational view showing the at rest relationship of the components.
Figure 3:
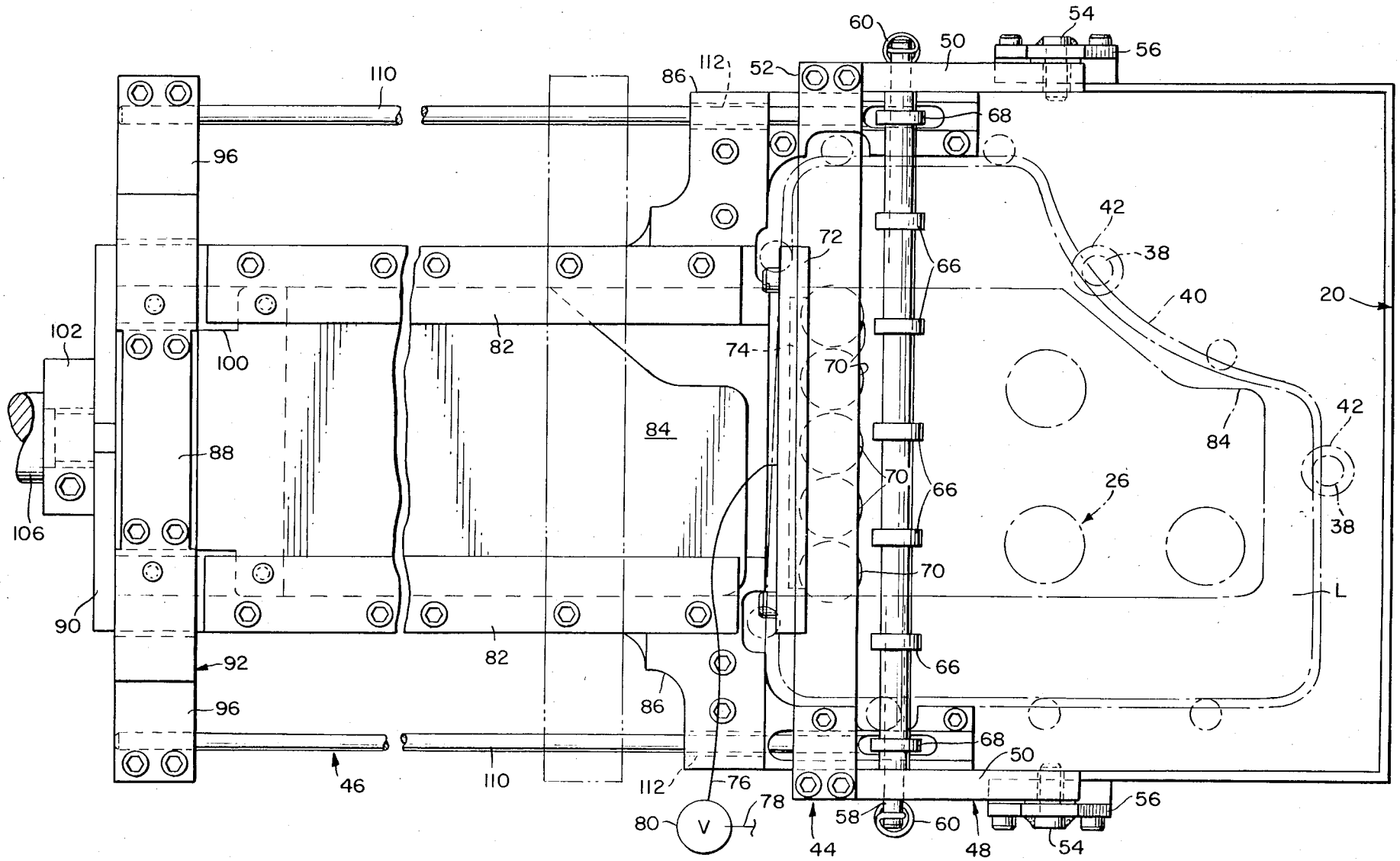
FIG. 3 is a bottom plan view on an enlarged scale of the label separator.

The blade 84 continues to move rearwardly as shown in FIG. 12 until it reaches its inoperative position as shown in FIG. 13. At this time, the actuating rods 110 have retracted so that the frame 48 is no longer cammed away from the label stack and the suction cups 70 and the rollers 66 have returned to their usual supporting position.

Figure 7:
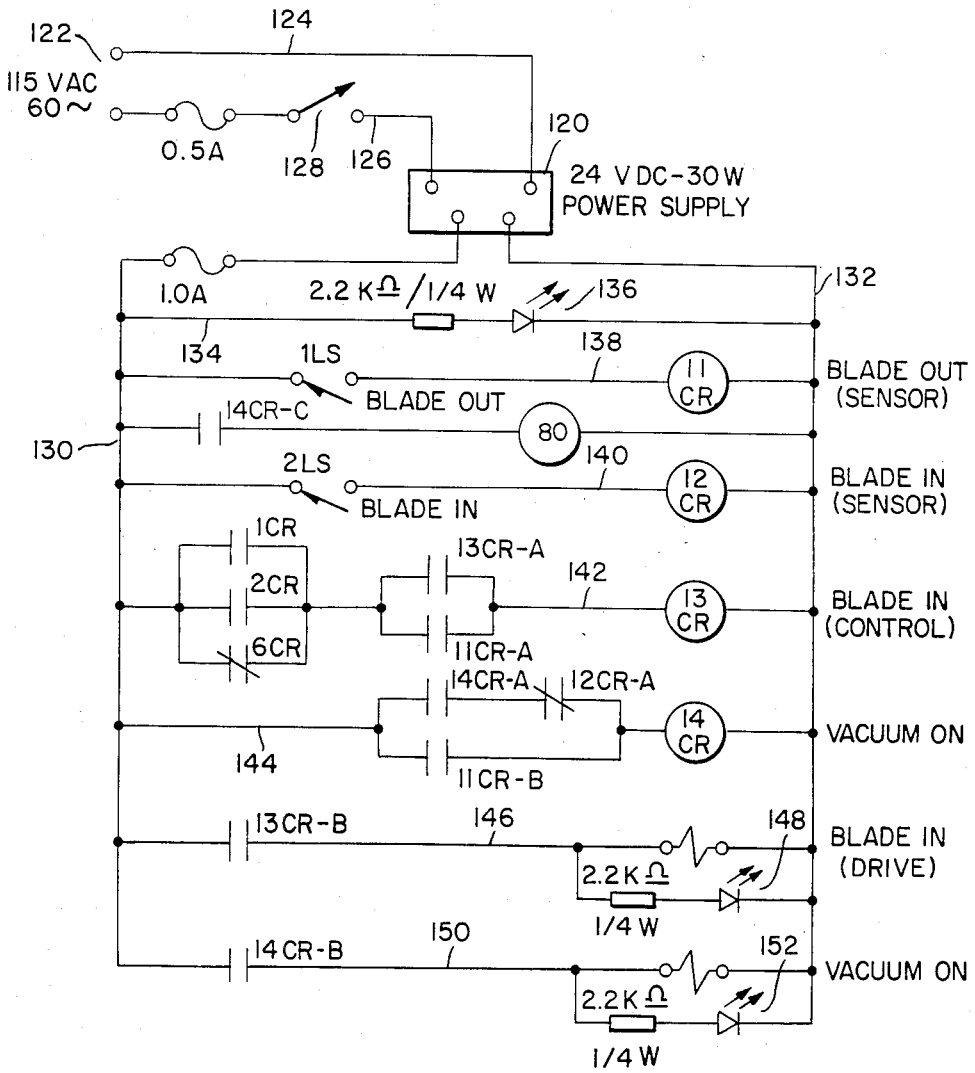
FIG. 7 is a wiring schematic.

It is to be understood that the operation of the label separator 34 is automatic in conjunction with the operation of the pickers 26 which are automatically actuated in a known manner when a mold half 32 reaches a preselected circumferential position to actuate proximity contacts PC (FIG. 2). To provide for this automatic operation, there is an electrical control system which is illustrated in FIG. 7. As shown in this figure, there is a 24 volt d.c. power supply 120 which is fed by a 115 volt a.c. power supply 122 by means of a pair of primaries 124, 126 in which there is provided an on-off switch 128.

The 24 volt d.c. power supply 120 has extending therefrom two leads 130, 132 which are arranged in parallel relation. Extending between the leads 130, 132 is a line 134 in which there is incorporated an on-off indicating light 136 of the LED type.

There is provided in a next line 138 a limit switch 1LS which controls the energization of a relay 11CR. The limit switch 1LS, as shown in FIG. 4, is mounted on the cylinder 106 and senses the position of the piston (not shown) to indicate that the blade 84 is in its out or retracted position.

A line 140 extends between the leads 130, 132 and has incorporated therein a limit switch 2LS which controls the energization of a relay 12CR. Referring once again to FIG. 4, it will be seen that the limit switch 2LS is also mounted on the cylinder 106 to sense when the piston (not shown) is in its fully advanced position, thus indicating when the blade is fully advanced.

A line 142 extends between the leads 130 and 132 and has incorporated therein a relay 13CR which is provided with several controls. These include contacts 1CRA, 2CRA and 6CRA which are arranged in parallel and wherein the contacts 1CRA and 2CRA are normally open and contact 6CRA is normally closed. The relays 1CR, 2CR and 6CR will be described in detail hereinafter.

There is also incorporated in the line 142 in series with the previously described relay contacts and in parallel to each other contacts 11CRA and 13CRA which are normally open.

A line 144 incorporating therein relay 14CR also extends between the leads 130 and 132. The line 144 also has incorporated therein contacts 14CRA, 12CRA and 11CRB. The contacts 14CRA and 12CRA are in series with each other and in parallel with the contact 11CRB. The contacts 14CRA and 11CRB are normally open while the contact 12CRA is normally closed. A line 146 has incorporated therein a normally open contact 13CRB which controls the energization of an indicator 148 of the LED type.

A line 150 which extends between the leads 130 and 132 has incorporated therein a normally open contact 14CRB which controls the energization of an indicator 152 which is also of the LED type.

It is to be understood that the relays 1CR, 2CR and 6CR are associated with the transfer unit 24 and the relay 1CR is energized to close the contact 1CRA when the pick-up head or picker 26 is at the magazine, as shown in FIG. 2. The relay 2CR is closed to close the contact 2CRA when the picker 26 moves to the area of the mold half 30, as shown in phantom lines in FIG. 2. The relay 6CR (FIG. 1) is energized to open contact 6CRA when the picker 26 moves away from the magazine 20 in the process of picking the label.

From the foregoing description of the control schematic, it will be seen that when the blade 84 is in its fully retracted position, the relay 11CR is energized which will result in the closing of the contacts 11CRA and 11CRB. This will result in the energization of the relay 14CR which, in turn, will result in the opening of the valve 80, the solenoid of which is controlled by the relay 14CR.

This will also result in the closing of the relay 13CR when the picker 26 is at the magazine or at the mold area, but not at a time when a label has been picked and is being transferred from the magazine 20 to the mold half 30. The relay 13CR controls the positioning of a valve 154 which selectively connects opposite ends of the cylinder 106 to a compressed air source 156 through lines 158 and 160 connected to opposite ends of the cylinder 106. The valve 154 when so actuated will supply air through the line 158 to the cylinder 106 to advance the blade 84.

It will be seen that as soon as the separated label L is picked by the picker 26, the circuit to the relay 13CR will be broken and the blade will automatically be retracted.

With respect to the circuitry to the relay 14CR which controls the application of vacuum to the suction heads 70, once the blade is fully in between the labels, the relay 12CR will be energized and the contact 12CRA will open to discontinue application of the vacuum so that the separated label L will be released for pick up by the picker 26. It is to be understood, of course, that the parallel circuit through contact 11CRB will be opened as soon as the blade 84 begins to advance.

Figure 14:
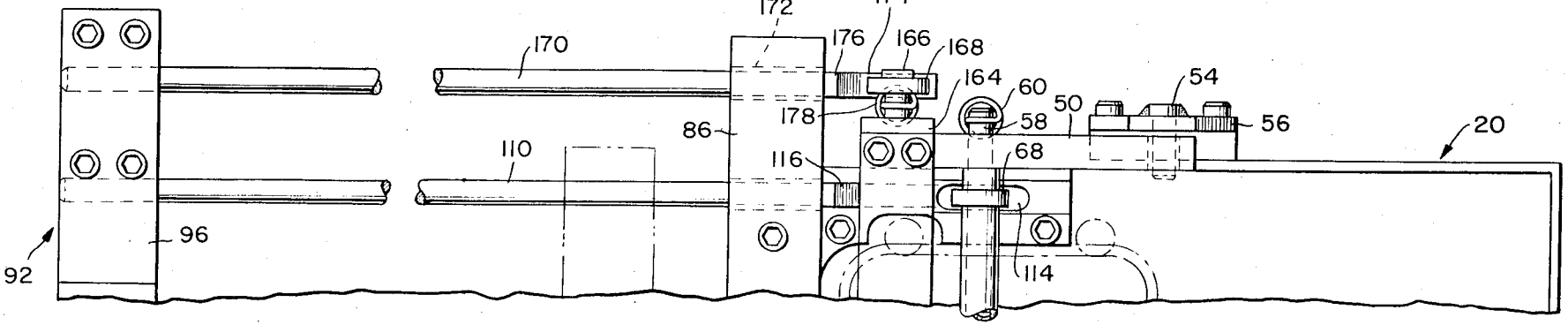
FIG. 14 is a fragmentary bottom plan view of the label separator showing a modified form thereof.
Figure 15:
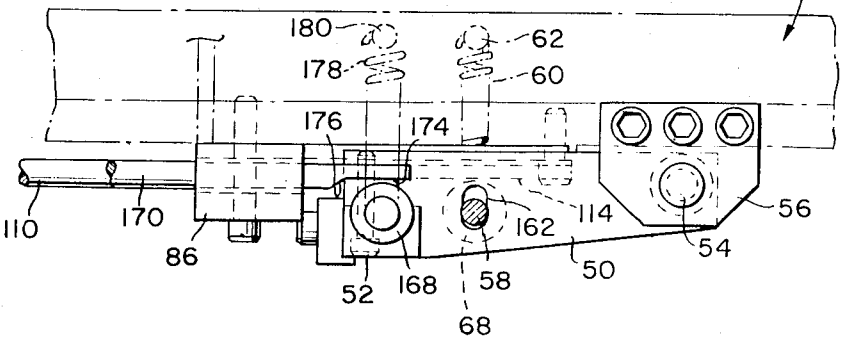
FIG. 15 is a fragmentary side elevational view of the embodiment of FIG. 14, and shows further details thereof.

Reference is now made to the embodiment of FIGS. 14 and 15 wherein the label support rollers 66 and the associated shaft 58 are mounted for vertical movement separate and apart from the frame 48. It is to be understood that the shaft 58 will be constantly urged upwardly toward the stack 118 by the springs 60 so that the stack will be constantly supported by the rollers 66. To this end, as is shown in FIG. 15, the portions of the shaft 58 which extend through the arms 50 are disposed in slots 162 so that the arms 50 may pivot independently of the movement of the shaft 58.

Referring now particularly to FIG. 14, it will be seen that each arm 50 has connected thereto a bracket 164 which carries a headed shaft 166 on which there is rotatably journalled a roller 168 in the form of a cam follower. There is associated with each of the cam followers an actuator rod 170 which is disposed parallel to an adjacent actuator rod 110 and which actuator rods 170 are guided in sleeve bearings 172 carried by the brackets 86 which are extended in the embodiment of FIGS. 14 and 15.

The outer portions 96 of the cross bar 92 are also extended and have clamped in the outer portions thereof the rear ends of the actuator rods 170.

The actuator rod has a flat forward portion 174 which initially underlies the roller 66. Adjacent each flat portion 174 is a cam portion 176 which engages the roller 168 when when the actuator rod 170 is advanced to urge the frame 48 downwardly independently to move the suction heads downwardly while the shaft 58 and the rollers 66 remain vertically stationary.

Each shaft 166 has connected thereto a tension spring 178 whose upper end is engaged over a fixed pin 180 as is shown in FIG. 15.

It is to be understood that the actuator rods 110 have been modified from those shown in FIGS. 3–6 in that the flat portions 114 thereof have been extended and the cam 116 is moved rearwardly or to the left, as shown in FIG. 14, so that the rollers 66 are not shifted until a time later than that at which the frame 48 and the suction head 70 are moved.

Figure 16:
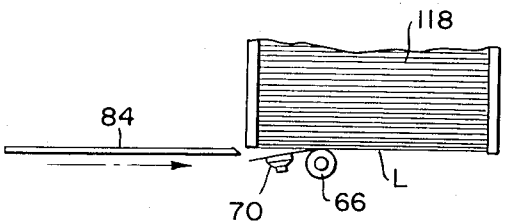
FIG. 16 is a schematic elevational view showing the initial step of displacing an edge portion of a label utilizing the modified form of separator.

With reference to FIG. 16, it will be seen that when the separator is energized and the blade 84 begins to move forward, the suction heads 70 move downwardly initially to peel an edge or end portion of the lowermost label L downwardly as also shown in FIG. 8. However, the rollers 66 remain stationary at this time.

Figure 17:
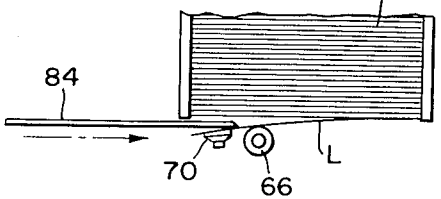
FIG. 17 is another schematic elevational view showing the blade partially inserted between the lowermost label in the stack and the support rollers having begun their descent.

Referring now to FIG. 17, it will be seen that after the blade 84 has been inserted in between the lowermost label L and the remainder of the stack 118, the cams 116 have engaged the rollers 68 and the rollers 66 have begun to move downwardly to provide for the movement of the blade 84 in between the lowermost label L and the remainder of the stack 118.

At this time, it is pointed out that when the magazine is a vertical magazine and the labels are being withdrawn from the bottom of the magazine, there is frequently a tendency for the labels to bow while they are within the stack. When the labels bow upwardly, the separator, as shown in FIGS. 3–6, functions in the desired manner. However, when the labels are bowed downwardly, as frequently occurs, when the labels are permitted to be lowered by the downward movement of the rollers 66, while the lowermost label L may be flat, the center portions of the next upper labels bow down into the path of the blade, with the result that the forward each of the blade engages the midsections of such labels and instead of freely moving beneath such labels, plows into the labels. By retaining the stack of labels in their normal positions by not depressing the support rollers 66, it will be seen that the blade 84, as shown in FIG. 17, may move sufficiently between the lowermost label and the remainder of the stack so as to assure further entry of the blade between the lowermost label and the stack without digging into the next lower label in the stack.

Although only a preferred embodiment of the label separator and a preferred environment for the blade separator have been specifically illustrated and described herein, it is to be understood that minor variations may be made in the blade separator construction and the blade separator may be utilized in other environments without departing from the spirit and scope of the invention as defined by the appended claims.

We claim:

1. Apparatus for separating a foremost label from all other labels of a stack of labels, said apparatus comprising displacing means for displacing at least an edge portion of a foremost label from all other labels of a stack, and separator means for thereafter moving between the foremost label and the remaining labels in the stack starting at said edge portion, said displacing means including a suction head mounted for movement in a direction of label dispensing from a label stack, label support means positioned adjacent to said suction head and fixed relative to said suction head for movement with said suction head.

2. Apparatus according to claim 1 wherein said separator means is in the form of a reciprocating blade and there is associated with said blade for reciprocation with said blade cam means for effecting pivoting of said suction head, said label support means includes a shaft, and cam followers carried by said shaft for engagement by said cam means.

3. Apparatus for separating a foremost label from all other labels of a stack of labels, said apparatus comprising displacing means for displacing at least an edge portion of a foremost label from all other labels of a stack, and separator means for thereafter moving between the foremost label and the remaining labels in the stack starting at said edge portion, a common actuator for said displacing means and said separator means, said common actuation being in the form of an extendable fluid motor, control means for controlling the actuation of said fluid motor, and label transfer means associated with said apparatus, and said control means being in part responsive to the position of said label transfer means.

4. Apparatus according to claim 3 wherein said control means also includes sensor means for sensing the position of said separator means.

5. Apparatus for separating a foremost label from all other labels of a stack of labels, said apparatus comprising displacing means for displacing at least an edge portion of a foremost label from all other labels of a stack, and separator means for thereafter moving between the foremost label and the remaining labels in the stack starting at said edge portion, said displacing means including a suction head mounted for movement in a direction of label dispensing from a label stack, and suction control means for controlling the application of suction to said suction head, said suction control means including means responsive to the position of said separator means.

6. A method of assuring the dispensing of a single label from a stack, said method comprising the steps of displacing an edge of a label from the remainder of the stack, and then inserting a separator between the label and the stack starting at the edge, the displacing step utilizes a suction head, and the application of suction to the suction head is controlled by the position of the separator.

* * * * *